US012729684B2

(12) United States Patent
Huang et al.

(10) Patent No.: US 12,729,684 B2
(45) Date of Patent: Sep. 8, 2026

(54) VORTEX COMPRESSOR

(71) Applicant: Robert Bosch GmbH, Stuttgart (DE)

(72) Inventors: Qilin Huang, Shanghai (CN); Yu Shi, Shanghai (CN); Maojun He, Shanghai (CN)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 19/032,347

(22) Filed: Jan. 20, 2025

(65) Prior Publication Data

US 2025/0237215 A1 Jul. 24, 2025

(30) Foreign Application Priority Data

Jan. 23, 2024 (CN) ..... 202410091819.7

(51) Int. Cl.
*F04C 18/02* (2006.01)
*F04C 29/00* (2006.01)

(52) U.S. Cl.
CPC ..... *F04C 18/0223* (2013.01); *F04C 18/0207* (2013.01); *F04C 18/0215* (2013.01); *F04C 18/0253* (2013.01); *F04C 29/0021* (2013.01); *F04C 29/0057* (2013.01)

(58) Field of Classification Search
CPC ..... F04C 18/0273; F04C 18/0207; F04C 18/0215; F04C 18/0253; F04C 29/0021; F04C 29/0057
USPC ..... 418/60
See application file for complete search history.

(56) References Cited

U.S. PATENT DOCUMENTS 5,616,015 A * 4/1997 Liepert ..... F04C 23/001 418/5
5,752,816 A * 5/1998 Shaffer ..... F01C 17/06 418/57
7,172,395 B2 * 2/2007 Shibamoto ..... F04C 23/001 418/60
2001/0043877 A1 * 11/2001 Iizuka ..... F04C 18/0238 418/101
2004/0234405 A1 * 11/2004 Tsuchiya ..... F04C 18/0215 418/60
2019/0264689 A1 * 8/2019 Park ..... F04C 29/12
2023/0258181 A1 * 8/2023 Suzuki ..... F04C 29/0021 418/55.4

FOREIGN PATENT DOCUMENTS

CN 1232732 C * 12/2005 ..... F04C 18/0215

OTHER PUBLICATIONS

Translation of CN-1232732C (Year: 2005).*

* cited by examiner

*Primary Examiner* — Charles G Freay
(74) *Attorney, Agent, or Firm* — Maginot, Moore & Beck LLP

(57) ABSTRACT

A vortex compressor includes (i) a housing, (ii) an interior chamber housed in the housing, (iii) a compression assembly having a static scroll fixed to the housing and a dynamic scroll mated and movably disposed with the static scroll, wherein a compression cavity is disposed between the static scroll and the dynamic scroll, (iv) a drive assembly having a main shaft and a drive plate connecting to the dynamic scroll, and the main shaft drives the dynamic scroll to revolve through the drive plate, and (v) and an anti-turn assembly for preventing the drive plate from self-rotation.

19 Claims, 9 Drawing Sheets

VORTEX COMPRESSOR

This application claims priority under 35 U.S.C. § 119 to patent application no. CN 2024 1009 1819.7, filed on Jan. 23, 2024 in China, the disclosure of which is incorporated herein by reference in its entirety.

The present disclosure relates to the field of compressor technology, and more particularly, to a vortex compressor.

BACKGROUND

The improvements of existing vortex compressors have focused primarily on increasing the suction and increasing the compression efficiency. Existing vortex compressors often use a single dynamic scroll to mate with a single static scroll to compress the media, thus there is a pressure imbalance at both the compression cavity side and the anti-turn hole side of the dynamic scroll, which in turn causes the dynamic scroll to be axially moved and therefore increase noise and wear of the dynamic scroll during operation. With the improvement of the vortex compressor, there is an improved design for the installation of a static scroll on each side of the dynamic scroll, but such a design requires the drive shaft to pass through the at least one static scroll to connect to the dynamic scroll, which leads to unavoidable exposure of the drive shaft to compressed media (particularly compressed high pressure media), which can adversely affect the drive shaft and the lubricating oil film on the drive shaft surface, the latter may in turn, contaminate the media. Thus, in the above improved design, there is still a risk that the lubricating oil film will not effectively lubricate the drive shaft over the long term, resulting in increased wear of the drive shaft and contamination of the media by the lubricating oil.

Thus, in the art, there is an urgent need for a vortex compressor capable of improving the pressure balance on both sides of the dynamic scroll and ensuring that the compressed media and the lubricating oil are not interconnected.

SUMMARY

In order to address the problems in the prior art described above, the present disclosure proposes a vortex compressor including a housing and an interior chamber housed in the housing, the latter contains: a compression assembly comprising a static scroll fixed to the housing and a dynamic scroll matched and moveably disposed with the static scroll, wherein a compression cavity is provided between the static scroll and the dynamic scroll; a drive assembly comprises a main shaft and a drive plate, the drive plate being connected to the dynamic scroll, the main shaft being used to drive the dynamic scroll to revolute; and an anti-turn assembly being used to prevent the drive plate from rotating.

The present disclosure may be embodied as a schematic example in the figures. It should be noted, however, that the figures are merely illustrative and that any changes contemplated under the teachings of the present disclosure shall be considered to be included within the scope of the present disclosure.

BRIEF DESCRIPTION OF THE DRAWINGS

The figures illustrate exemplary examples of the present disclosure. These drawings should not be construed as necessarily limiting the scope of the present disclosure, wherein.

DETAILED DESCRIPTION

Further features and advantages of the present disclosure will become more apparent from the description that follows with reference to the accompanying drawings. Exemplary examples of the present disclosure are shown in the figures, and the various figures are not necessarily drawn in actual proportions. However, the disclosure may be implemented in many different forms and should not be construed as necessarily limiting to the exemplary examples disclosed herein. Rather, these exemplary examples are merely provided for illustrative purposes of the present disclosure and for conveying the spirit and essence of the present disclosure to those skilled in the art.

The present disclosure aims to present a vortex compressor with a novel design that improves the operation performance of the vortex compressor by enabling the pressures on both sides of the dynamic scroll to remain balanced during media compression, thereby ensuring the reliable operation of the vortex compressor, and effectively inhibiting issues such as axial movements, vibrations, and noise caused by the overturning torque during operation of the dynamic scroll. In addition, the vortex compressors according to the present disclosure are able to isolate the media from the main shaft due to its novel design, thereby protecting the lubricating oil film of the main shaft surface from being damaged (particularly the compressed, high-pressure media) or even contaminated by the media, while protecting the lubricating oil film of the main shaft surface not only ensures reliable operation of the main shaft, but also reduces wear of the main shaft and other components such as bearings attached thereto, thereby extending the lifespan of various components including the main shaft. Accordingly, the vortex compressor according to the present disclosure has not only improved operational performance, but also extended service life.

A plurality of optional but non-limiting embodiments of a vortex compressor according to the present disclosure are described in detail below with reference to the various figures.

Figure 1:
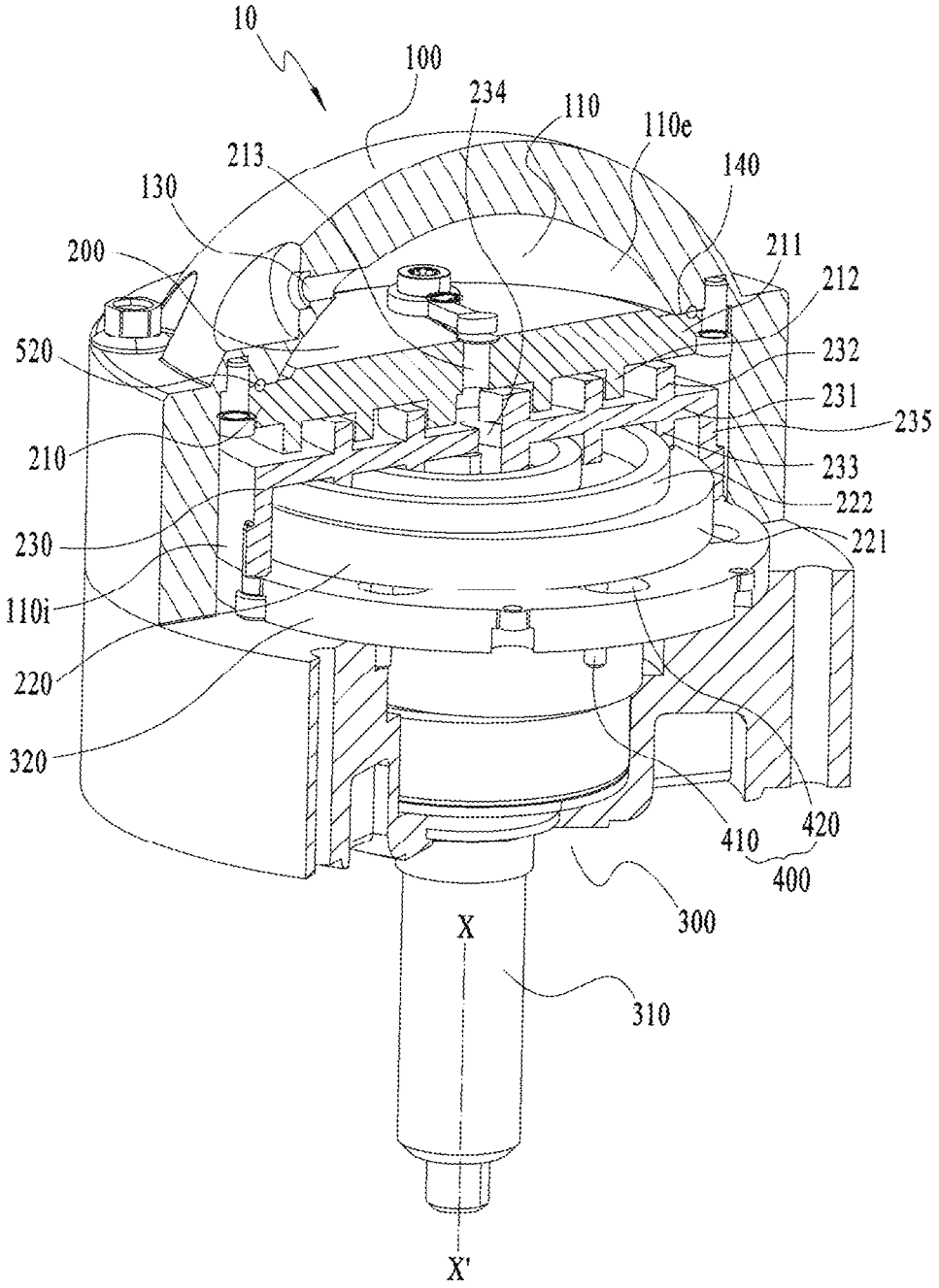
FIG. 1 is a partially sectioned stereoscopic view of a vortex compressor according to one embodiment of the present disclosure.

Referring to FIG. 1, a partially sectioned stereoscopic view of a vortex compressor according to one embodiment of the present disclosure is shown. As shown in FIG. 1, the vortex compressor 10 primarily includes a housing 100, a compression assembly 200, a drive assembly 300, and an anti-turn assembly 400, wherein the housing 100 defines an interior chamber 110 internally, the compression assembly 200, the drive assembly 300, and the anti-turn assembly 400 are housed in the interior chamber 110, and the drive assembly 300 matches with the anti-turn assembly 400 to drive the compression assembly 200. The compression assembly 200 may include a first and a second static scrolls 210, 220 fixedly disposed within the interior chamber 110 and a dynamic scroll 230 movably disposed within the interior chamber 110. The first and second static scrolls 210, 220 may be connected to the housing 100 in the interior chamber 110 by fasteners such as bolts, screws, rivets, etc. so as to be secured in the interior chamber 110. The dynamic scroll 230 is positioned along the axial direction XX' between the first and second static scrolls 210, 220, i.e., the first and second static scrolls 210, 220 are positioned at sides against or opposite the dynamic scroll 230 along the axial direction XX' (i.e., the first side facing the first static scroll 210 and second side facing the second static scroll 220) and the dynamic scroll 230 may be rotated relative to the first and second static scrolls 210, 220. As such, as will be described in detail below, the media (e.g., a type of coolant such as R744, R134A, R290, etc.) may be compressed on both sides of the dynamic scroll 230 by the mating of the dynamic scroll 230 with the first and second static scrolls 210, 220. The drive assembly 300 may include a main shaft 310 rotatably disposed in the interior chamber 110, which may be coupled to a rotor of an electric motor (not shown). Additionally, as will be described in detail below, the anti-turn assembly 400 may include a plurality of posts 410 and a plurality of anti-turn holes 420.

As used herein, the terms "axial direction", "radial direction", "circumferential direction" etc., have their ordinary meaning in the art, in particular, the axial direction XX' may be a direction that is parallel to or coincident with the axis of rotation of the main shaft 310, i.e., may be defined by the axis of rotation of the main shaft 310; the radial direction may be any direction that is perpendicular to the axis of rotation of the main shaft 310; and the circumferential direction may be any direction that surrounds the axis of rotation of the main shaft 310.

With continued reference to FIG. 1, the first static scroll 210 includes a first static plate body 211 fixedly connected to the housing 100 and a first static scroll body 212 protruding and vortexing from one side of the first static plate body 211, and the second static scroll 220 includes a second static plate 221 fixedly connected to the housing 100 and a second static scroll body 222 protruding and vortexing from one side of the second static plate body 221, and dynamic scroll 230 includes dynamic plate body 231 movably positioned between the first static scroll 210 and the second static scroll 220, and the first and second dynamic scroll bodies 232, 233 protruding and vortexing from both sides of dynamic plate body 231. In addition, the end of the first static scroll body 212 abuts the dynamic plate body 231, while the end of the first static scroll body 232 abuts the first static plate body 211, and the side surface of the first dynamic scroll body 232 engages with the side surface of the first static scroll body 212, whereby the first static scroll body 212 defines a plurality of compression cavities proximate to each other and with respect to the respective volumes of the first dynamic scroll body 232, which are routed along the vortexing direction and separated from each other, their volumes decrease as they approach the center of each vortex. Likewise, the end of the second static scroll body 222 abuts against the dynamic plate body 231, while the end of the second static scroll body 233 abuts against the second static plate body 221, and the side surface of the second dynamic scroll body 233 engages with the side surface of the second static scroll body 222, whereby the second static scroll body 222 defines a plurality of compression cavities proximate to each other and with respect to the respective volumes of the second dynamic scroll body 233, which are routed along the vortexing direction and separated from each other, their volumes decrease as they approach the center of each vortex. As the dynamic scroll 230 moves relative to the first and second static scrolls 210, 220, the various compressed cavities on both sides of the dynamic scroll 230 will move towards the center of the respective vortex body along the vortex direction and its volume will gradually decrease, which causes the media in the various compressed cavities to move towards the center of the respective dynamic scroll 230 and be gradually compressed, while the pressure of the media will increase accordingly and be maximized when the media moves to the center of the respective vortex body. Thus, in order to drain the high pressure media on both sides of the dynamic scroll 230, the first static plate body 211 of the first static scroll 210 has a first through-hole 213 extending through the center of the first static scroll body 212, while the dynamic plate body 231 of the dynamic scroll 230 has a second through-hole 234 that connects the center of the first dynamic scroll body 232 to the center of the second dynamic scroll body 233, through which the media compressed at the first side of the dynamic scroll 230 can be exhausted passing the first through-hole 213, and the media compressed at the second side of the dynamic scroll 230 can be exhausted passing the second through-hole 234 and then first through-hole 213.

In the above configuration, as the dynamic scroll 230 is mated with two static scrolls on both sides to compress the media, as compared to existing compressors that are only compressing on one side of the dynamic scroll, the vortex compressor 10 according to the present disclosure is able to significantly reduce the pressure differentials on both sides of the dynamic scroll 230, thereby inhibiting issues such as axial movements, vibrations, and noise during operation of the dynamic scroll 230, which not only improves the performance of the vortex compressor 10 but also extends the service life of the various components.

In particular, the first and second static scroll bodies 212, 222 are symmetrically arranged and have the same height with respect to the dynamic plate body 231, and the first and second dynamic scroll bodies 232, 233 are symmetrically arranged and have the same height with respect to the dynamic plate body 231. In this configuration, the various compressed cavities defined by the first static scroll body 212 and the first dynamic scroll body 232 on the first side of the dynamic plate body 231 will be symmetrical and have the same volume as the compressed cavities defined by the second static scroll body 222 and second dynamic scroll body 233 on the second side of the dynamic plate body 231. The media pressure in compression cavities of the same volume is the same, so the pressure on both sides of dynamic plate body 231 can be totally balanced, and the axial movements, vibrations, and noise of dynamic scroll 230 during operation can be largely suppressed. Therefore, there can be further improvement of the performance of vortex compressor 10 and extension of the service life of components.

Figure 7:
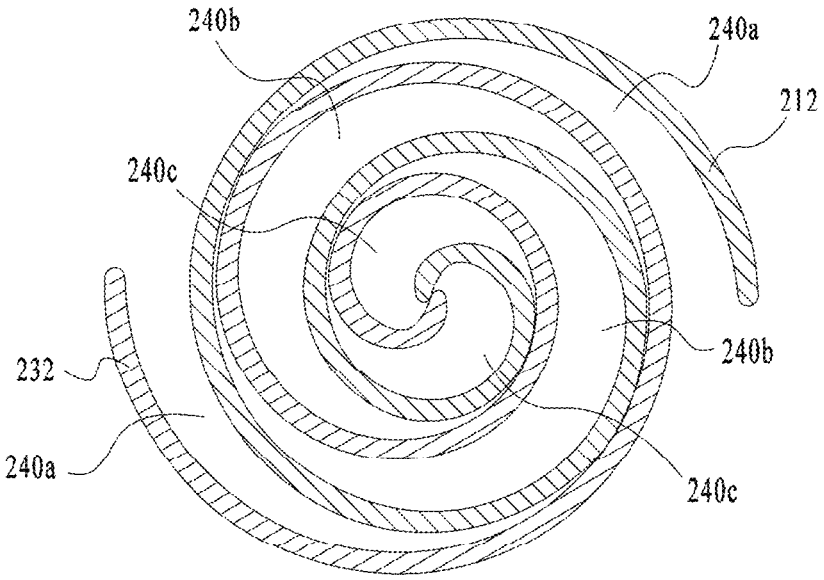
FIG. 7 is a schematic cross-sectional view of the first dynamic scroll and first static scroll in the first position of the vortex compressor shown in FIGS. 1-4.
Figure 8:
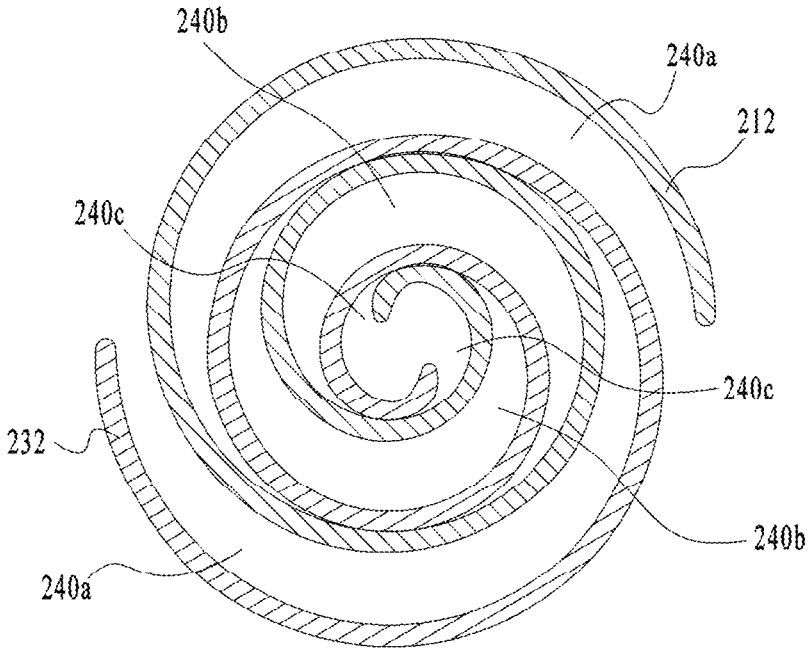
FIG. 8 is a schematic cross-sectional view of the first dynamic scroll and first static scroll in the second position of the vortex compressor shown in FIGS. 1-4.
Figure 9:
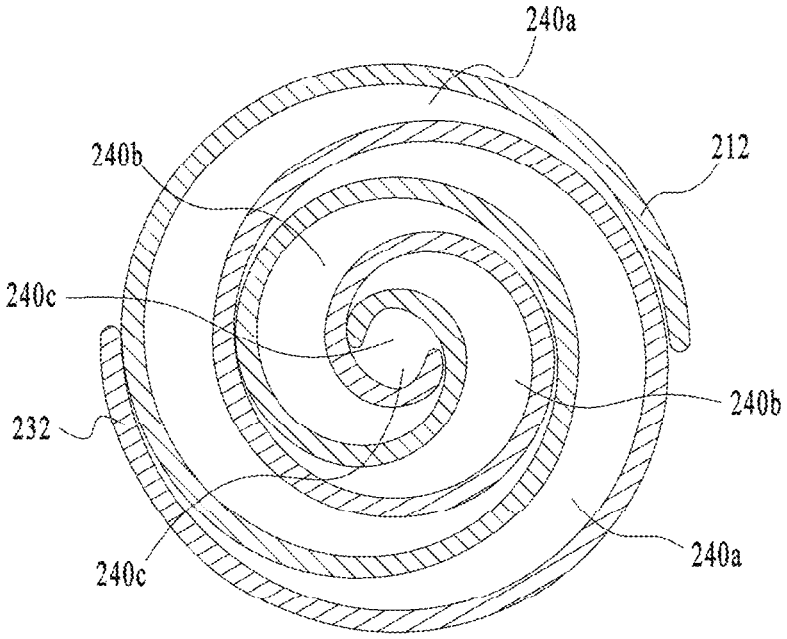
FIG. 9 is a schematic cross-sectional view of the first dynamic scroll and first static scroll in the third position of the vortex compressor shown in FIGS. 1-4.

To make the above-described compression process more comprehensible, the following is illustrated with the example of the first static scroll body 212 and the first dynamic scroll body 232. Referring to FIGS. 7-9, a schematic cross-sectional view of the first dynamic scroll body 232 and first static scroll body 212 in different positions is shown. As shown in FIGS. 7-9, the first dynamic scroll body 232 and the first static scroll body 212 define two sets of compressed cavities that are symmetrically distributed with respect to each other with respect to the first static scroll body 212, wherein each set of compressed cavities includes a first compressed cavity 240*a*, a second compressed cavity 240*b*, and a third compressed cavity 240*c* that are arranged inwardly and separated from each other in a vortex direction. When the first dynamic scroll body 232 is in the first position shown in FIG. 7, the first compressed cavity 240*a* is open so as to receive the medium to be compressed in the first compressed cavity 240*a* and the second compressed cavity 240*b* and the third compressed cavity 240*c* are closed. When the first dynamic scroll body 232 is moved from the first position shown in FIG. 7 to the second position shown in FIG. 8, the first compressed cavity 240*a* moves towards the center of the first static scroll body 212 and begins to close, the second compressed cavity 240*b* and the third compressed cavity 240*c* move towards the center of the first static scroll body 212 and decrease in volume to compress the respective received media. When the first dynamic scroll body 232 is further moved from the second position shown in FIG. 8 to the third position shown in FIG. 9, the first compressed cavity 240*a* moves further towards the center of the first static scroll body 212 and closes, the second and third compressed cavities 240*b*, 240*c* moves further towards the center of the first static scroll body 212 and further decrease in volume to further compress the respective received media. When the first dynamic scroll body 232 is further moved from the third position shown in FIG. 9 to the first position shown in FIG. 7, the third compressed cavity 240*c* completely expels its media and disappears, the second compressed cavity 240*b* becomes a new third compressed cavity 240*c*, the first compressed cavity 240*a* becomes a new second compressed cavity 240*b*, and a new first compressed cavity 240*a* is created.

In the above configuration, by movement of the first dynamic scroll body 232, the media may enter between the first static scroll body 212 and the first vortex 232 radially from the outside, then move towards the center of the two scroll bodies and compress, and finally expel at the center of the two scroll bodies. According to the said principles of compression, the two scroll bodies can continuously draw in, compress, and expel the media by the continuous movement around the first dynamic scroll body 232. It is to be noted that although the compression principle described above is taken as an example of the first static scroll body 212 and the first dynamic scroll body 232, it will be understood by those skilled in the art that the same compression principle applies to the second static scroll body 222 and the second dynamic scroll body 233. In addition, the number of compressed cavities defined by the two scroll bodies is not inevitable, for example, depending on the particular structure of the individual scroll bodies, the two sets of compressed cavities in the two groups of compressed cavities arranged symmetrically with respect to the vortex can comprise three, four, or even more compressed cavities. Thus, the specific structure of the scroll bodies cannot constitute a limitation on the protective scope of the present disclosure. As can be seen from FIGS. 7-9, in order to compress the media, the movement of the first dynamic scroll body 232 is not about rotation about one axis or translation in one direction, but rather revolute about one axis (may also be referred to as translational motion).

Figure 2:
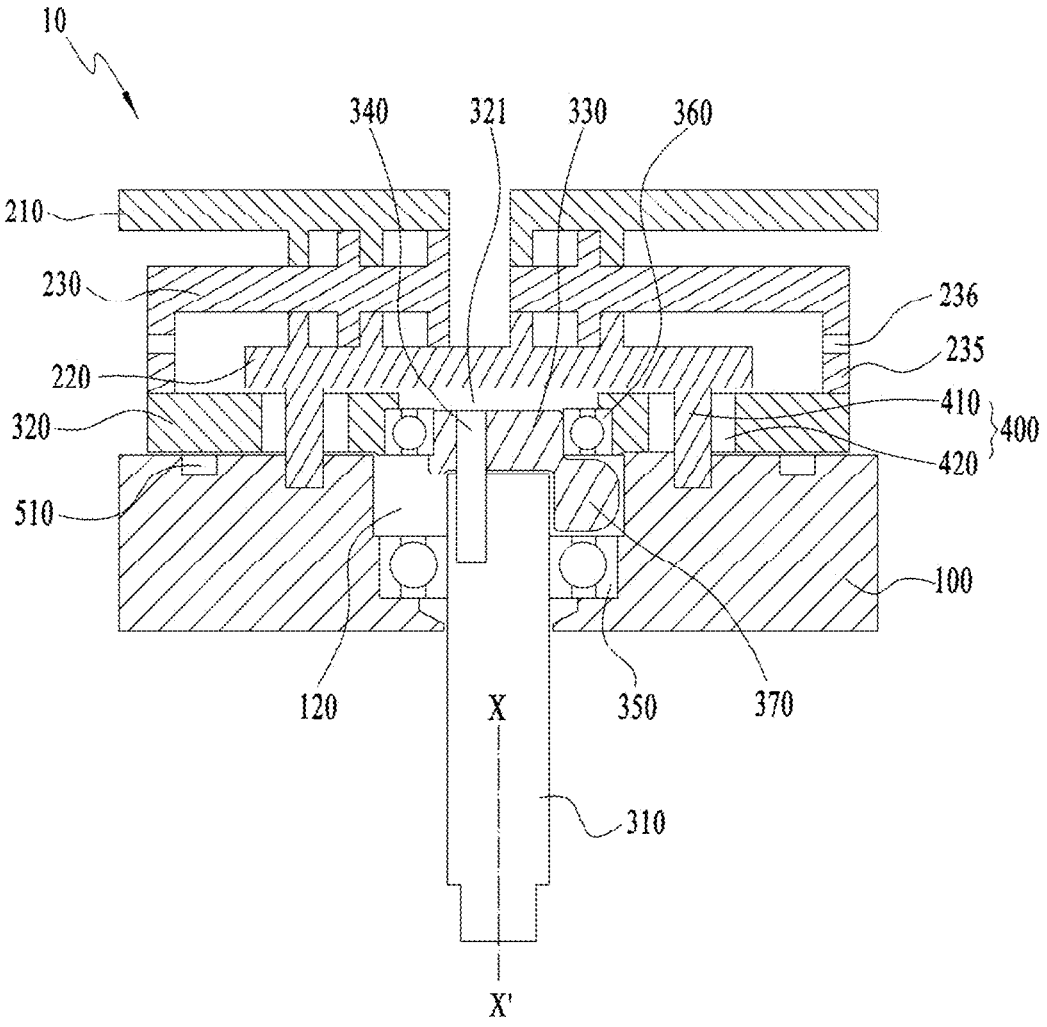
FIG. 2 is a cross-sectional view of a partial assembly of the vortex compressor shown in FIG. 1.

In order to convert rotation of the main shaft 310 into the revolution of the first dynamic scroll body 232, also known as the dynamic scroll 230, reference is made to FIG. 2, which shows a cross-sectional view of a portion of the components of the vortex compressor shown in FIG. 1. As shown in FIGS. 1 and 2, the drive assembly 300 also includes a drive plate 320 positioned on the opposite side of the second static scroll 220 to the dynamic scroll 230 such that the second static scroll 220 is positioned between the dynamic scroll 230 and the drive plate 320. In addition, the dynamic scroll 230 is fixedly connected to the drive plate 320, which in turn is coupled to the main shaft 310 so that the motion from the main shaft 310 can pass through the drive plate 320 to the dynamic scroll 230.

The second static scroll 220 is provided with a plurality of posts 410 (e.g., cylindrical) protruding from the second static plate body 221 through which the second static plate body 221 is fixedly connected to the housing 100, and the drive plate 320 is provided with a plurality of anti-turn holes 420 (e.g., in circles), where each of the anti-turn holes 420 is passed through by an extended post 410, and the radial dimension (e.g., radial diameter) of each anti-turn hole 420 is greater than the radial dimension (e.g., radial diameter) of each post 410. That is, the second static scroll 221 is fixedly connected to the housing 100 by a plurality of posts 410 extending through the plurality of anti-turn holes 420 of the drive plate 320 and there is a gap between the sidewalls of the anti-turn holes 420 and the sidewalls of the posts 410 that allows the posts 410 to rock in the anti-turn holes 420. In this configuration, the self-rotation of the drive plate 320 is prevented by the multiple anti-turn holes 420 mating with the multiple posts 410, thereby enabling the drive plate 320 to only be revoluted around the axis of rotation of the main shaft 310 with rotation of the main shaft 310, whereby rotation of the main shaft 310 can be converted into a rotation of the drive plate 320 and the dynamic scroll 320. That is, the main shaft 310 can drive through the drive plate 320 to drive the dynamic scroll 230 to rotate around the axis of rotation of the main shaft 310 such that the dynamic scroll 230 interacts with the first and second static scrolls 210, 220 on both sides to compress the media on both sides. In addition, in this configuration, the second static scroll 220 can space apart the main shaft 310 from various compression cavities, which can further improve the operation performance of the vortex compressor by preventing media (especially compressed high pressure media) from contaminating or even breaking the main shaft 310 and the lubricating oil film on its surface, and by avoiding pressure fluctuations in the various compression cavities from acting on the main shaft 310 and the lubricating oil film on its surface, thereby reducing noise, vibrations, and wear during rotation of the main shaft 310.

In particular, as shown in FIGS. 1 and 2, the dynamic scroll 230 may include a connecting wall 235 protruding from the driven dynamic plate body 231 radially outward of the second dynamic scroll body 233 that extends across the second static scroll 220 until the drive plate 320 and is fixedly connected to the drive plate 320 (e.g., through fasteners like bolts, screws, rivets, etc.). That is, the dynamic scroll 230 can be fixedly connected to the drive plate 320 through its connecting wall 235. Additionally, the connecting wall 235 of the dynamic scroll 230 is spaced apart from the second static scroll 220 in the radial direction to allow movement of the dynamic scroll 230 relative to the second static scroll 220. More particularly, the connecting wall 235 may be arranged continuously along the circumferential direction, such as along the perimeter of the dynamic scroll 231, such that the connecting wall 235 is generally annular, thereby increasing the area of contact of the connecting wall 235 with the drive plate 320 to enable the drive plate 320 to drive the dynamic scroll 230 motion more reliably and stably. Of course, in this case, the connecting wall 235 requires a plurality of input holes 236 distributed along the circumferential direction to allow media to enter from the outside of the connecting wall 235 to the inside thereof and further into between the second static scroll 220 and the dynamic scroll 230.

Figure 3:
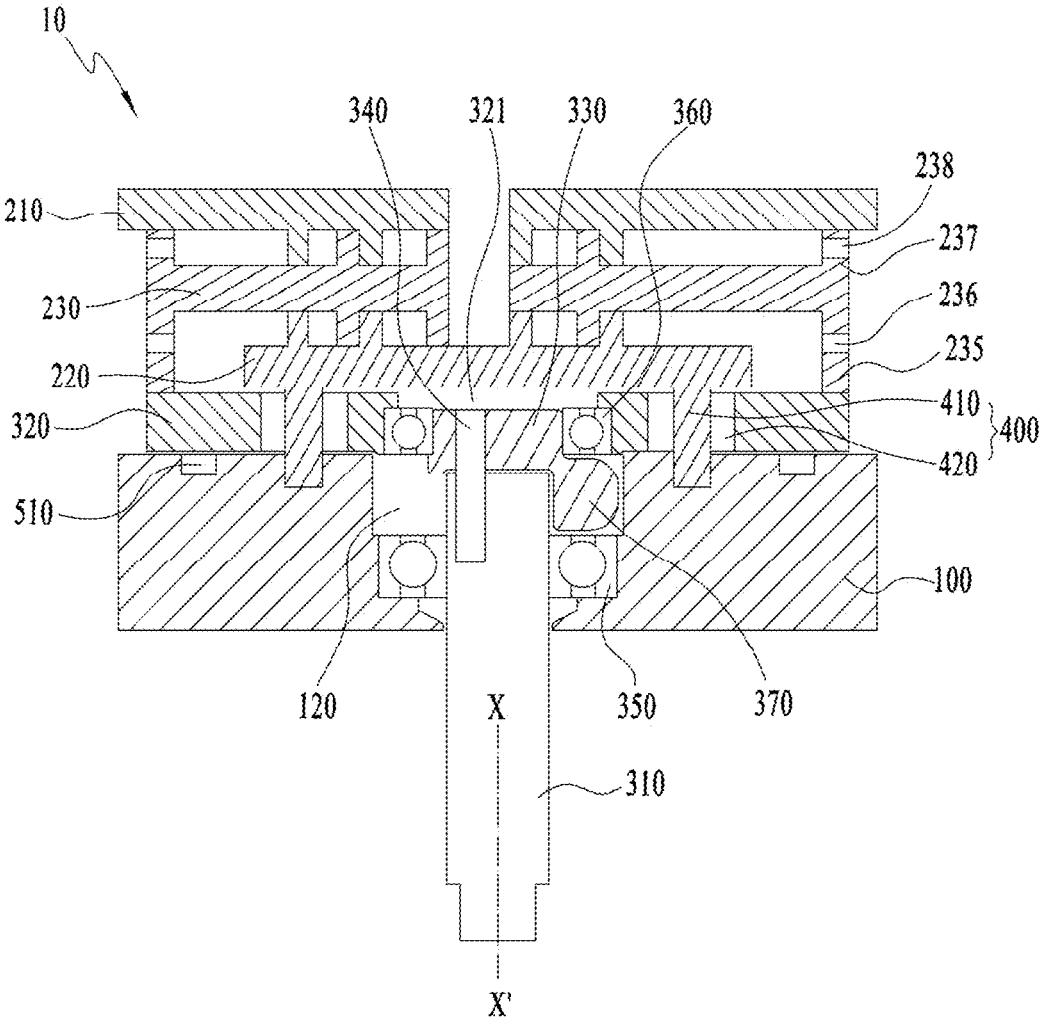
FIG. 3 is a cross-sectional view of a partial assembly of a vortex compressor according to another embodiment of the present disclosure.

Referring to FIG. 3, a cross-sectional view of a partial assembly of a vortex compressor according to another embodiment of the present disclosure is shown. The embodiment shown in FIG. 3 differs from the embodiment shown in FIGS. 1 and 2 in that, in addition to the connecting wall 235, the dynamic scroll 230 includes a support wall 237 protruding from the dynamic plate body 231, opposite the connecting wall 235, i.e., the support wall 237 is symmetrically arranged on both sides of the dynamic plate body 231 with the connecting wall 235. In addition, the support wall 237 may lean against the first static plate body 211 of the first static scroll 210, and set with multiple input holes 238, which can be symmetrically arranged with each of the input holes 236 of the connecting wall 235 with respect to the dynamic plate body 231 and of the same size. In this configuration, on the one hand, the media needs to enter between the second static scroll body 222 and second dynamic scroll body 233 by the input holes 236 in the connecting wall 235, on the other hand, the media needs to enter between the first static scroll body 212 and the first dynamic scroll body 232 through the input holes 238 in the support wall 237. With respect to the symmetrically arranged input holes 236 and the input holes 238 of the same dimension on dynamic plate body 231, they can make sure that the media volumes entered into both scrolls are the same, and further ensure that the pressure is fully balanced between both sides of dynamic plate body 231 to suppress the axial movements, vibrations, and noise of dynamic scroll 230 during the operation.

Figure 4:
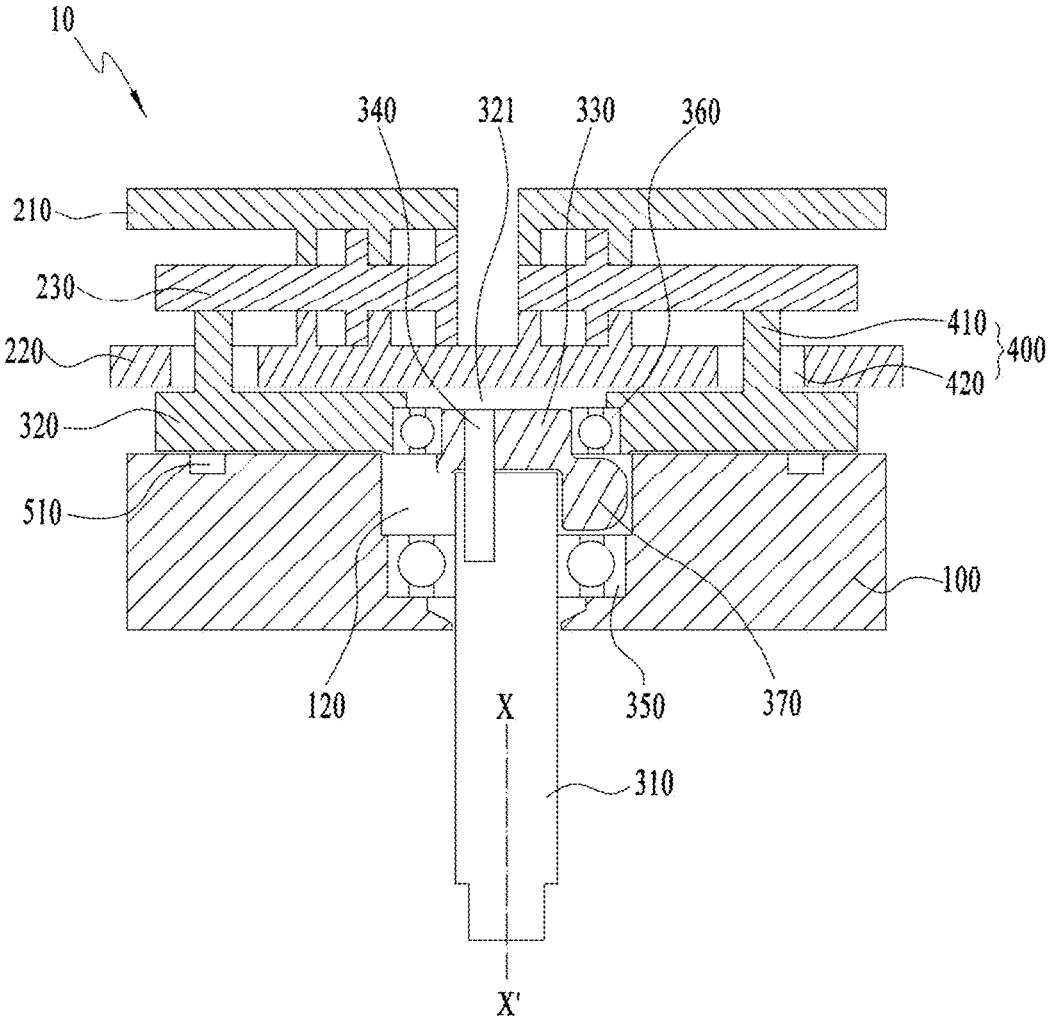
FIG. 4 is a cross-sectional view of a partial assembly of a vortex compressor according to yet another embodiment of the present disclosure.

Referring to FIG. 4, a cross-sectional view of a partial assembly of a vortex compressor according to yet another embodiment of the present disclosure is shown. The embodiment shown in FIG. 4 differs from the embodiment shown in FIG. 1-FIG. 3 in that multiple posts 410 are not disposed on the second static plate body 221 of the second static scroll 220, but rather on the drive plate 320 and are used to connect the drive plate 320 to the dynamic scroll body 231 of dynamic scroll 230 and the plurality of anti-turn holes 420 are not disposed in the drive plate 320, but through the second static plate body 221 of the second static scroll 220, for passing-through of multiple posts 410. In this configuration, the drive plate 320 can drive, through the plurality of posts 410, the dynamic scroll 230 to move, and the plurality of posts 410, coupled with the plurality of anti-turn holes 420, can prevent the dynamic scroll 230 from self-rotating, which can translate rotation of the main shaft 310 into a revolution of the dynamic scroll 230.

As can be seen from the embodiment of FIGS. 1-4, the plurality of posts 410 and the plurality of anti-turn holes 420 may constitute an anti-turn assembly 400 of the vortex compressor 10, where the plurality of posts 410 may be disposed on the second static scroll 220 or drive plate 320, while the plurality of anti-turn holes 420 may be disposed in the drive plate 320 or the second static scroll 220, because of the anti-turn assembly 400, the rotation of main shaft 310 may be converted to the revolution (not the self-rotation) of dynamic scroll 230.

Figure 5:
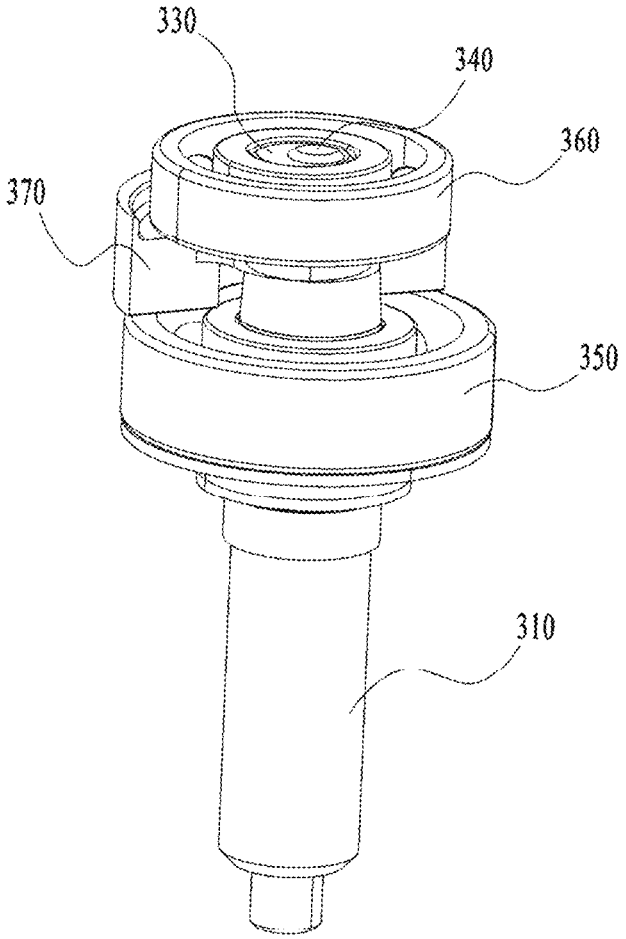
FIG. 5 is a schematic stereoscopic view of the drive assembly of the vortex compressor shown in FIGS. 1-4.

Referring to FIG. 5, a schematic stereoscopic view of the drive assembly of the vortex compressor shown in FIGS. 1-4 is shown, and the drive plate has been removed for clarity. As shown in FIGS. 1-5, the housing 100 is provided with a primary hole 120 through which the main shaft 310 passes, the drive plate 320 has a secondary hole 321 radially inward of the multiple posts 410 and the multiple anti-turn holes 420, the secondary hole 321 is spaced apart from the multiple posts 410 and the multiple anti-turn holes 420 in the radial direction, and the drive assembly 300 also includes a secondary shaft 330 and a connecting shaft 340 connecting secondary shaft 330 to the main shaft 310. Specifically, the main shaft 310 is supported by the primary bearing 350 in the primary hole 120 of the housing 100, i.e., the main shaft 310 mates with the primary hole 120 in the housing 100 through the primary bearing 350. The secondary shaft 330 is supported by the secondary bearing 360 in the secondary hole 321 of the drive plate 320, i.e., the secondary shaft 330 mates with the secondary hole 321 in the drive plate 320 through the secondary bearing 360. The connecting shaft 340 is inserted into the main shaft 310 in a stationary and off-center manner relative to the main shaft 310 and into the secondary shaft 330 in a rotatable and off-center manner relative to the secondary shaft 330 so that the secondary shaft 330 is connected to the main shaft 310 in an off-center manner relative to the main shaft 310. The so-called off-center manner refers to the axis of rotation of the main shaft 310, the axis of the secondary shaft 330, and the axis of the transfer shaft 340 being parallel to each other but not coincident, i.e., spaced along the radial direction. In this configuration, the secondary shaft 330 will drive the drive plate 320, through the rotation of the main shaft 310, to revolute about the rotation axis of the main shaft 310 and, in turn, through the drive plate 320 to drive the dynamic scroll 230 to revolute and complete the compression of the media described above, although in this process the anti-turn assembly 400 may ensure that the dynamic scroll 230 is revoluting through suppression of self-rotation of the dynamic scroll 230. In addition, in this configuration, the second static scroll 220 can space apart the various components of the main shaft 310, the secondary shaft 330, the connecting shaft 340, the primary bearing 350, the secondary bearing 360, etc., from various compressed cavities and the media (particularly the compressed high-pressure media), thereby preventing the media from contaminating or even damaging the components and lubricating oil film of these component surfaces, and preventing the components and their lubricating oil film from being subjected to the pressure surge from pressure cavities, thereby reduce the axial movements, vibrations, and noise of these components during operation, and further improve the working performance and prolong life span of vortex compressors.

Figure 6:
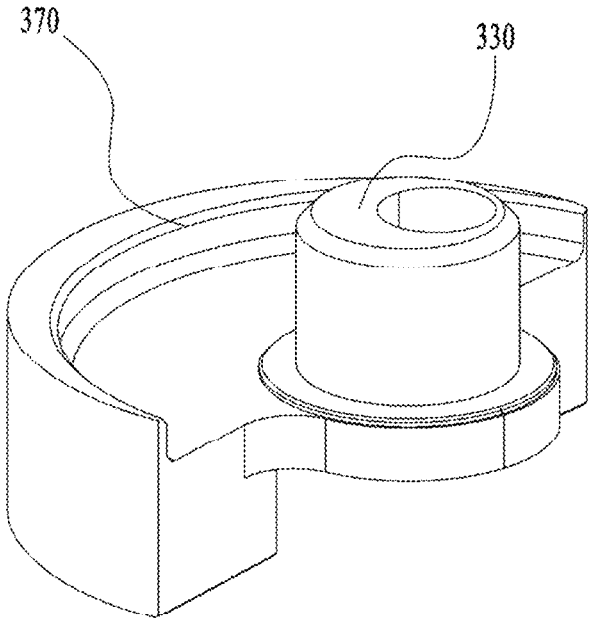
FIG. 6 is a schematic stereoscopic view of the secondary shaft of the drive assembly of the vortex compressor shown in FIGS. 1-5.

In particular, referring to FIG. 6, a schematic stereoscopic view of the secondary shaft of the drive assembly of the vortex compressor shown in FIGS. 1-5 is shown. As shown in FIGS. 1-6, the drive assembly 300 may also include an eccentric block 370 that is fixedly connected to and axially biased, radially outward relative to the secondary shaft 330, and the secondary shaft 330 and the eccentric block 370 are configured and assembled such that the axis of the eccentric block 370 and the axis of the secondary shaft 330 are located along the diameter direction of the axis of main shaft 310, that is to say, the center of gravity of eccentric block 370 and the axis of secondary shaft 330 locates on both sides of main shaft 310. In this configuration, since the center of gravity of the eccentric block 370 and the axis of the secondary shaft 330 are located on both sides of the axis of rotation of the main shaft 310, the secondary shaft 330, the secondary bearing 360, the drive plate 320, and the dynamic scroll 230, as a whole, its center of gravity and eccentric block 370's center of gravity are located on both sides of the axis of rotation of the main shaft 310, making the eccentric block 370 rotating on the other side of the rotation axis of main shaft 310 when the drive plate 320 and dynamic scroll 230 are revoluting around rotation axis of main shaft 310, thereby the centrifugal force on main shaft 310 applied by drive plate 320 and dynamic scroll 230 is neutralized by the centrifugal force on main shaft 310 by eccentric block 370, so as to reduce the vibration of main shaft 310 during rotation and ensure its more stable rotation.

In particular, the primary bearing 350 may cooperate with the primary hole 120 in the main shaft 310 and housing 100 in an interference fit manner, while the secondary bearing 360 may cooperate with the secondary shaft 330 and secondary hole 321 in the drive plate 320 in a gap fit manner. That is, the primary bearing 350 may operate in a secure bearing manner and the secondary bearing 360 may operate in a floating bearing manner. In this configuration, the main shaft 310 may be more reliably supported by the primary bearing 350 on the one hand, and the secondary bearing 360 on the other hand may reduce the difficulty of assembly of the secondary shaft 330. While the secondary bearing 360, which is a floating bearing, may be impinged on various side surfaces as the drive plate 320 is driven to revolute, the lubricating oil film of the secondary bearing 360 on various side surfaces may evenly distribute the pressure generated by the impinging, thereby reducing the pressure exerted on various side surfaces, thereby protecting the secondary bearing 360 from damage. In addition, as previously noted, the lubricating oil film is also protected from high pressure media and pressure surge, and thus the secondary bearing 360 can be reliably protected from damage for a long time.

In particular, the vortex compressor 10 also includes sealing rings 510 arranged along the circumferential direction radially outward of the plurality of anti-turn holes 420 and clamped between the drive plate 320 and the housing 100. In this configuration, the sealing rings 510 may prevent media from entering the primary hole 120 through the gap between the drive plate 320 and the housing 100, thereby preventing media from contaminating or even damaging the main shaft 310, the primary bearing 350 and the lubricating oil film on the surface of the components. More particularly, the housing 100 may have annular grooves for receiving the seal rings 510 for more accurate and reliable positioning of the seal rings 510. In addition, in an embodiment not shown, the vortex compressor 10 further includes sealing rings arranged outward along the circumferential direction and clamped between the drive plate 320 and the second static scroll 220 of the plurality of anti-turn holes 420 and/or sealing rings arranged inward along the circumferential direction and clamped between the drive plate 320 and the second static scroll 220 of the plurality of anti-turn holes 420. This may thereby more reliably avoid the media from contacting various components of the drive assembly 300. The seal can be a graphite nylon material that is self-lubricating.

In particular, in the embodiment shown in FIGS. 1-3, each of the anti-turn holes 420 may be covered or closed by a second static plate body 221 of the second static scroll 220 proximate a side of the second static scroll 220 and covered or closed by the housing 100 proximate a side of the housing 100. In the embodiment shown in FIG. 4, each of the anti-turn holes 420 may be covered or closed by the drive plate 320 on a side proximate the drive plate 320. In this configuration, it is effective to avoid the media entering into the secondary hole 321 through the anti-turn hole 420, thereby preventing the media from contaminating or even damaging the secondary shaft 330, the secondary bearing 360 and the lubricating oil film on the surface of components.

In particular, back to FIG. 1, the inner chamber 110 has an input portion 110*i* located radially outward of the dynamic scroll 230 and an output portion 110*e* located opposite the dynamic scroll 220 of the first static scroll 210 with separation from one another, and the housing 100 has a first input hole (not shown) in communication with the input portion 110*i* and an output hole 130 in communication with the output portion 110*e*, and the first through-hole 213 of the first static scroll 210 is in 25 communication with the output portion 110*e*. In this configuration, the media from the upstream can enter the input portion 110*i* of the interior chamber 110 through the input holes in the housing 100, which in turn is absorbed and compressed by the vortex structure on both sides of the dynamic scroll 230, and then discharged through the second through-hole 234 and the first through-hole 213 to the output portion 110*e* of the interior chamber 110, and finally discharged through the output hole 130. In particular, the housing 100 is internally formed with an annular surface 140 surrounding the output portion 110*e* of the interior chamber 110, and the first static plate body 211 of the first static scroll 210 is engaged with the annular surface 140, separating the input portion 110*i* and the output portion 110*e* of the interior chamber 110 from one another. More particularly, the vortex compressor 10 also includes sealing rings 520 clamped between the first static plate body 211 and the annular surface 140. In this configuration, the input portion 110*i* and the output portion 110*e* of the interior chamber 110 may be isolated from each other more reliably by the seal rings 520 to prevent high-pressure media in the output portion 110*e* from leaking into the input portion 110*i*.

The above optional but non-limiting examples of a vortex compressor according to the present disclosure are described in detail above with reference to the figures. For those skilled in the art, without departing from the spirit and substance of the present disclosure, modifications and additions to techniques and structures and recombination of features in various examples shall clearly be considered to be included within the scope of the present disclosure. Therefore, such modifications and supplements that may be conceived under the guidance of the present disclosure shall be considered as part of the present disclosure. The scope of the present disclosure includes known equivalent technologies and equivalent technologies not yet foreseen as of the filing date of this disclosure.

What is claimed is:

1. A vortex compressor, comprising:

a housing;

an interior chamber housed in the housing;

a compression assembly including a static scroll fixed to the housing and a dynamic scroll mated and moveably disposed with respect to the static scroll, wherein a compression cavity is disposed between the static scroll and the dynamic scroll;

a drive assembly including a main shaft and a drive plate connected to the dynamic scroll, the main shaft being configured to drive a revolution of the dynamic scroll through the drive plate; and an anti-turn assembly configured to prevent self-rotation of the drive plate, the anti-turn assembly including a plurality of posts protruding from the static scroll and a plurality of anti-turn holes disposed in the drive plate, wherein the plurality of posts are fixed directly to the housing.

2. The vortex compressor of claim 1, wherein the drive assembly further includes a secondary shaft that is off-centered to the main shaft and rotatably received in the drive plate such that the main shaft and the secondary shaft are axially spaced apart from the static scroll.

3. The vortex compressor of claim 2, wherein a secondary hole is provided in the drive plate, the secondary shaft being received in the secondary hole, and both of the main shaft and the secondary hole being isolated from the compression cavity.

4. The vortex compressor of claim 2, wherein the drive assembly further comprises:

a primary bearing disposed in the housing and supporting the main shaft; and a secondary bearing disposed on the drive plate and supporting the secondary shaft.

5. The vortex compressor of claim 4, wherein the primary bearing is both in interference fit with the housing and the main shaft, and the secondary bearing is both in gap fit with the drive plate and the secondary shaft.

6. The vortex compressor of claim 2, wherein the drive assembly further includes:

a connecting shaft that is inserted off-center and fixedly into the main shaft and is inserted off-center and rotatably into the secondary shaft, and an eccentric block fixed to the secondary shaft and that is axially and radially offset relative to the secondary shaft such that the axis of the secondary shaft and the center of gravity of the eccentric block are positioned on opposite sides of the axis of the main shaft.

7. The vortex compressor of claim 1, wherein the static scroll includes a first and a second axially separated static scrolls fixed to the housing, the dynamic scroll being movably disposed between and mated with the first and second static scrolls, respectively.

8. The vortex compressor of claim 7, wherein the plurality of posts protrude from the second static scroll.

9. The vortex compressor of claim 7, wherein the first static scroll is provided with a first static scroll body, the second static scroll is provided with a second static scroll body, and the dynamic scroll is provided on both sides with a first dynamic scroll body that mates with the first static scroll body and a second dynamic scroll body that mates with the second static scroll body.

10. The vortex compressor of claim 7, wherein the interior chamber has an input portion positioned radially outward of the dynamic scroll and an output portion positioned on an opposite side of the first static scroll to the dynamic scroll.

11. The vortex compressor of claim 7, wherein the inner diameter of each of the plurality of anti-turn holes is greater than the outer diameter of each of the plurality of posts.

12. The vortex compressor of claim 11, wherein the vortex compressor further comprises:

sealing rings circumferentially arranged and radially outward of the plurality of anti-turn holes and clamped between the drive plate and the housing; and/or sealing rings circumferentially arranged and radially outward of the plurality of anti-turn holes and clamped between the drive plate and the second static scroll; and/or sealing rings circumferentially arranged and radially inward of the plurality of anti-turn holes and clamped between the drive plate and the second static scroll.

13. A vortex compressor, comprising:

a housing;

an interior chamber housed in the housing;

a compression assembly including a static scroll fixed to the housing and a dynamic scroll mated and moveably disposed with respect to the static scroll, wherein a compression cavity is disposed between the static scroll and the dynamic scroll;

a drive assembly including a main shaft and a drive plate connected to the dynamic scroll, the main shaft being configured to drive a revolution of the dynamic scroll through the drive plate; and an anti-turn assembly configured to prevent self-rotation of the drive plate, wherein the static scroll includes a first and a second axially separated static scrolls fixed to the housing, the dynamic scroll being movably disposed between and mated with the first and second static scrolls, respectively, and wherein the first static scroll is provided with a first through-hole that communicates with a center of the first static scroll body opposite the side of the dynamic scroll, and the dynamic scroll is provided with a second through-hole that communicates a center of the first dynamic scroll body with a center of the second dynamic scroll body.

14. A vortex compressor, comprising:

a housing;

an interior chamber housed in the housing;

a compression assembly including a static scroll fixed to the housing and a dynamic scroll mated and moveably disposed with respect to the static scroll, wherein a compression cavity is disposed between the static scroll and the dynamic scroll;

a drive assembly including a main shaft and a drive plate connected to the dynamic scroll, the main shaft being configured to drive a revolution of the dynamic scroll through the drive plate; and an anti-turn assembly configured to prevent self-rotation of the drive plate, wherein the static scroll includes a first and a second axially separated static scrolls fixed to the housing, the dynamic scroll being movably disposed between and mated with the first and second static scrolls, respectively, wherein the first static scroll is provided with a first static scroll body, the second static scroll is provided with a second static scroll body, and the dynamic scroll is provided on both sides with a first dynamic scroll body that mates with the first static scroll body and a second dynamic scroll body that mates with the second static scroll body, and wherein the first and second static scroll bodies are arranged symmetrically and have the same height with respect to the dynamic scroll and the first and second dynamic scroll bodies are arranged symmetrically and have the same height.

15. A vortex compressor, comprising:

a housing;

an interior chamber housed in the housing;

a compression assembly including a static scroll fixed to the housing and a dynamic scroll mated and moveably disposed with respect to the static scroll, wherein a compression cavity is disposed between the static scroll and the dynamic scroll;

a drive assembly including a main shaft and a drive plate connected to the dynamic scroll, the main shaft being configured to drive a revolution of the dynamic scroll through the drive plate; and an anti-turn assembly configured to prevent self-rotation of the drive plate, wherein the static scroll includes a first and a second axially separated static scrolls fixed to the housing, the dynamic scroll being movably disposed between and mated with the first and second static scrolls, respectively, and wherein the dynamic scroll is provided with a connecting wall that surrounds the second static scroll and is fixed to the drive plate, the connecting wall being located radially outward of and spaced from the second static scroll.

16. The vortex compressor of claim 15, wherein the connecting wall is arranged in a circumferentially continuous circular manner with a plurality of input holes.

17. The vortex compressor of claim 16, wherein the dynamic scroll is further provided with a support wall symmetrically arranged with the connecting wall, the support wall being in abutting contact the first static scroll and having a plurality of input holes, each input hole being arranged symmetrically with each input hole of the connecting wall.

18. A vortex compressor, comprising:

a housing;

an interior chamber housed in the housing;

a compression assembly including a static scroll fixed to the housing and a dynamic scroll mated and moveably disposed with respect to the static scroll, wherein a compression cavity is disposed between the static scroll and the dynamic scroll;

a drive assembly including a main shaft and a drive plate connected to the dynamic scroll, the main shaft being configured to drive a revolution of the dynamic scroll through the drive plate; and an anti-turn assembly configured to prevent self-rotation of the drive plate, wherein the static scroll includes a first and a second axially separated static scrolls fixed to the housing, the dynamic scroll being movably disposed between and mated with the first and second static scrolls, respectively, wherein the anti-turn assembly includes a plurality of posts and a plurality of anti-turn holes, wherein each post passes through one anti-turn hole and the diameter of the anti-turn hole is greater than the diameter of the post, and wherein the plurality of posts protrude from one of the second static scroll and the drive plate, and the anti-turn holes are disposed in one of the other of the second static scroll and the drive plate, and wherein the plurality of anti-turn holes is defined in the drive plate and is covered by the second static scroll and the housing on opposite sides of the drive plate, respectively.

19. A vortex compressor, comprising:

a housing;

an interior chamber housed in the housing;

a compression assembly including a static scroll fixed to the housing and a dynamic scroll mated and moveably disposed with respect to the static scroll, wherein a compression cavity is disposed between the static scroll and the dynamic scroll;

a drive assembly including a main shaft and a drive plate connected to the dynamic scroll, the main shaft being configured to drive a revolution of the dynamic scroll through the drive plate; and an anti-turn assembly configured to prevent self-rotation of the drive plate, wherein the static scroll includes a first and a second axially separated static scrolls fixed to the housing, the dynamic scroll being movably disposed between and mated with the first and second static scrolls, respectively, wherein the interior chamber has an input portion positioned radially outward of the dynamic scroll and an output portion positioned on an opposite side of the first static scroll to the dynamic scroll, wherein the housing forms an annular surface arranged about an inside of the output portion, the first static scroll engaging the annular surface to isolate the input portion from the output portion from one another, and wherein sealing rings are clamped between the first static scroll and the annular surface.

* * * * *